United States Patent [19]

Steinman et al.

[11] Patent Number: 4,809,127

[45] Date of Patent: Feb. 28, 1989

[54] SELF-REGULATING AIR IONIZING APPARATUS

[75] Inventors: Arnold J. Steinman; Michael G. Yost, both of Berkeley; Donald A. Gehlke, Corona Del Mar, all of Calif.

[73] Assignee: Ion Systems, Inc., Berkeley, Calif.

[21] Appl. No.: 85,082

[22] Filed: Aug. 11, 1987

[51] Int. Cl.[4] ..... H01T 23/00; H01H 47/32; H05F 3/00

[52] U.S. Cl. ..... 361/213; 361/229; 361/231; 361/235

[58] Field of Search ..... 361/213, 229, 230, 231, 361/235

[56] References Cited

U.S. PATENT DOCUMENTS

| | | | |
|---|---|---|---|
| Re. 30,826 | 12/1981 | Laws | 361/231 |
| 2,264,495 | 12/1941 | Wilner | 361/231 |
| 3,337,784 | 8/1967 | Lueder | 361/231 |
| 3,417,302 | 12/1968 | Lueder | 361/231 |
| 3,711,743 | 1/1973 | Bolasny | 361/231 |
| 4,264,858 | 4/1981 | Archer | 361/235 |
| 4,467,961 | 8/1984 | Coffee | 361/231 |
| 4,484,812 | 11/1984 | Takayanagi | 361/235 |
| 4,542,434 | 9/1985 | Gehlke et al. | 361/231 |

OTHER PUBLICATIONS

R. H. Dunphy et al, "A Computer Controlled Room Air Ionization System".

(Author and date not known) "Computer Controlled Air Ionization", 10 pages, distributed by Voyager Technologies, Inc.

*Primary Examiner*—L. T. Hix

*Assistant Examiner*—David Porterfield

*Attorney, Agent, or Firm*—Phillips, Moore, Lempio & Finley

[57] ABSTRACT

Apparatus for ionizing air molecules to suppress electrostatic charges in a room or for other purposes includes internal feedback which maintains a desired rate of ion production in the presence of electrode deterioration or other effects which could otherwise alter ion output. Production of air ions of a given polarity results in a ground return flow of electrical charges of opposite polarity from the high voltage generator at a rate corresponding to the rate of air ion output. The ground return current is monitored to produce an electrical feedback signal. A control circuit causes the high voltage generator to apply higher voltage to the electrode when the feedback signal decreases and to apply lower voltage to the electrode when the feedback signal increases. Such self-regulation of each individual electrode in systems having an array of electrodes that are otherwise jointly controlled acts to maintain a desired ratio of positive and negative ions in a room as well as a desired total ion concentration.

18 Claims, 4 Drawing Sheets

SELF-REGULATING AIR IONIZING APPARATUS

TECHNICAL FIELD

This invention relates to apparatus for increasing the ion content of air and more particularly to regulation of the ion output of air ionizers.

BACKGROUND OF THE INVENTION

Air ionizers have one or more sharply pointed electrodes to which high voltage is applied. The resulting intense electrical field in the vicinity of the sharp points dissociates nearby air molecules into positive and negative ions. Ions having a polarity opposite to that of the high voltage are attracted to the electrode and neutralized, Ions of the same polarity as the high voltage are repelled by the electrode and by each other and disperse outwardly from the ionizer into the surrounding atmosphere.

Air ionizers of the above described kind were originally designed primarily for producing beneficial effects in people who breathe the air and/or for removing particulate pollutants, such as dust, smoke or the like, from the air. Negative air ions in particular are physiologically beneficial while ions of either polarity remove pollutants by imparting an electrical charge to such particles. The charged particles then deposit on nearby walls or other objects as a result of electrostatic attraction.

The ion output rate of such apparatus is basically determined by the magnitude of the high voltage and the area and configuration of the electrode ion output regulation in early ionizers was usually confined to use of a voltage regulator in the high voltage generator power supply. The regulator in effect maintained the high voltage on the electrode at a fixed or in some cases selectable level. This does not assure that ion output will remain constant over a period of time. The electrode deteriorates and changes configuration as a result of the corona discharge which occurs at the point or points of the electrode. This typically causes a gradual decrease in the rate of ion production. Deterioration of other components can also alter ion output.

A more precise regulation of ion output is desirable under some circumstances. Most notably, air ionizers have been found to be a highly effective means for suppressing the build-up of electrostatic charges on objects in a room. Objects and people tend to acquire electrostatic charges ranging up to several thousand volts as a result of movement and the accompanying friction, from inductive effects and by discharges from other objects. Sudden discharges of such static electricity can be discomforting to people and can damage a variety of devices and articles. Computers and recording equipment, among many other examples, can be disrupted by electrostatic discharges.

Elaborate precautions must be taken in so called clean rooms in which semiconducting electronic components are manufactured. Electrostatic discharges can destroy the minute conductive paths in microcircuits. Static charges on semiconductor wafers or the like also attract damaging dust particles and other contaminants. Maintaininq a high level of air ions in the region around such products is one of the more effective techniques for minimizing damage as an electrostatic charge of given polarity is neutralized by charge exchange with air ions of opposite polarity.

Air ionizing apparatus for suppressing static electricity accumulations are usually designed to produce both positive and negative ions. The charge accumulations on objects can be of either polarity. This creates a need for precise regulation of the output of ions of each type.

The desired rates of production of positive and negative ions may be equal or may have some other ratio depending on the static charge accumulating tendencies of the particular clean room. In either case, a change in the ratio of positive and negative ion outputs brought about by electrode deterioration or other causes can have adverse effects. The ionizing apparatus may then tend to impart electrostatic charge to objects rather than suppressing such charges. A change in the combined output rates of the positive and negative ions from such causes may also have adverse effects.

The rate of air ion generation at a particular electrode can be controlled by adjusting the magnitude of the high voltage that is applied to the electrode. Higher voltage increases ion output and lowered voltage decreases output. Such use of voltage control to maintain a desired rate of ion production requires monitoring of ion output to detect changes.

Prior monitoring systems for this purpose use ion sensing devices which are situated away from the ionizing electrodes and which are usually located in the region of the objects on which static charge is to be suppressed. The ion sensor transmits a signal indicative of changes of ion content in the adjacent air. The signal may be read on a meter to enable manual adjustment of electrode voltage or may be fed back to a servo control at the high voltage generator for automatic adjustment of voltage.

Ion sensor controlled systems have significant limitations and disadvantages. Such sensors pick up environmental noise and have a limited spatial range. Ion sensors are also costly. These are highly significant disadvantages in large area systems which may include an array of many spaced apart ionizing electrodes. A number of sensors are needed to detect imbalances of positive and negative ions or changes in total ion content throughout a room. Ideally such a system would include one air ion sensor for each ionizing electrode but the high cost of the devices has made this impractical in many cases.

Usage of air ionizing apparatus would be greatly facilitated by a construction which inherently maintains a desired high concentration of ions in the nearby atmosphere and a desired ratio of negative to positive ions and which does so in an accurate and reliable manner and without excessive costs.

SUMMARY OF THE INVENTION

In one aspect, the present invention provides air ionizing apparatus having at least one electrode exposed to air which is to be ionized, a high voltage generator which applies high voltage of a predetermined polarity to the electrode and which includes a ground return electrical resistance through which electrical charges of opposite polarity are conducted away from the high voltage generator at a rate corresponding to the rate of air ion production by the electrode. Sensing means produce an electrical feedback signal having a magnitude that varies in correspondence with variations of the voltage drop across the electrical resistance. The apparatus further includes voltage adjusting means which receives the feedback signal and causes the high voltage generator to apply higher voltage to the electrode in response to a decrease of the feedback signal and to apply lower voltage to the electrode in response to an increase of the signal.

In another aspect, the apparatus further includes control means for generating a voltage control signal indicative of a desired ion output rate. The voltage adjusting means varies the high voltage produced by the high voltage generator in accordance with changes in the voltage control signal and also in inverse relationship to changes in the feedback signal.

In another aspect, the invention provides air ionizing apparatus having a plurality of spaced apart ion emitters, an electrical power source and a plurality of high voltage generators. Each generator is connected to the power source and to separate one of the ion emitters and each has an electrically resistive path through which a return current flows away from the generator that is of opposite polarity from the voltage produced by the generator and which has a magnitude corresponding to the rate of ion output from the emitter that is connected to the generator. A first portion of the generators produce positive high voltage and a second portion produce negative voltage. Return current sensing means produce a plurality of feedback signal voltages each of which varies in accordance with variations of the return current flow from a separate one of the high voltage generators. The apparatus further includes means for varying the high voltage produced by each generator in inverse relationship to variations of the feedback signal voltage from that particular generator. The apparatus maintains a predetermined total ion output and produces negative and positive ions at a substantially constant ratio.

In still another aspect of the invention, air ionizing apparatus includes a plurality of spaced apart air ionizing units each having at least one ion emitter electrode exposed to ambient air. Each of a plurality of high voltage generators in the units has a high voltage output connected to a separate one of the electrodes and each has means for varying the output voltage of that particular generator in response to a voltage control signal. A first portion of the generators are negative voltage generators and another portion produce positive high voltage. A control housing has an electrical power source and means for alternately and repetitively producing a first voltage control signal for the negative high voltage generators and a separate second voltage control signal for the positive high voltage generators. A multi-conductor cable extends from the control housing to each of the ionizing units and has an input power conductor connected to each of the high voltage generators, first and second voltage control signal conductors and a ground return conductor which receives a ground return current flow from each generator that is of opposite polarity from the voltage produced by the generator and which has a magnitude equal to the ion output at the electrode that is connected to the generator. The apparatus further includes a plurality of feedback circuits each being connected between a separate one of the high voltage generators and the ground return conductor and to one of the voltage control signal conductors. Each of the feedback circuits includes means for actuating the generator that is connected to the circuit in response to received voltage control signals and means for varying the voltage output of the generator in inverse relationship to variations of the reburn current flow from the generator.

Air ionizing apparatus embodying the invention inherently maintains a substantially constant predetermined total ion output in the presence of electrode deterioration or input power voltage fluctuations A substantially constant predetermined ratio of negative and positive ion outputs is also maintained in apparatus having plural ion emitters of different polarity as the ion output of each individual emitter in the system is self-regulated independently of the ion outputs of the others. A localized region of unbalanced negative and positive air ion content does not occur if a particular electrode deteriorates more rapidly than nearby electrodes of opposite polarity. One form of the invention also includes means for varying the voltage on each individual electrode to compensate for the neutralization of air ions which may occur at another nearby electrode. The invention accurately and reliably regulates air ion content without necessarily relying on continuous monitoring of the ion content of the air with costly air ion sensors.

DETAILED DESCRIPTION OF THE PREFERRED EMBODIMENT

Figure 1:
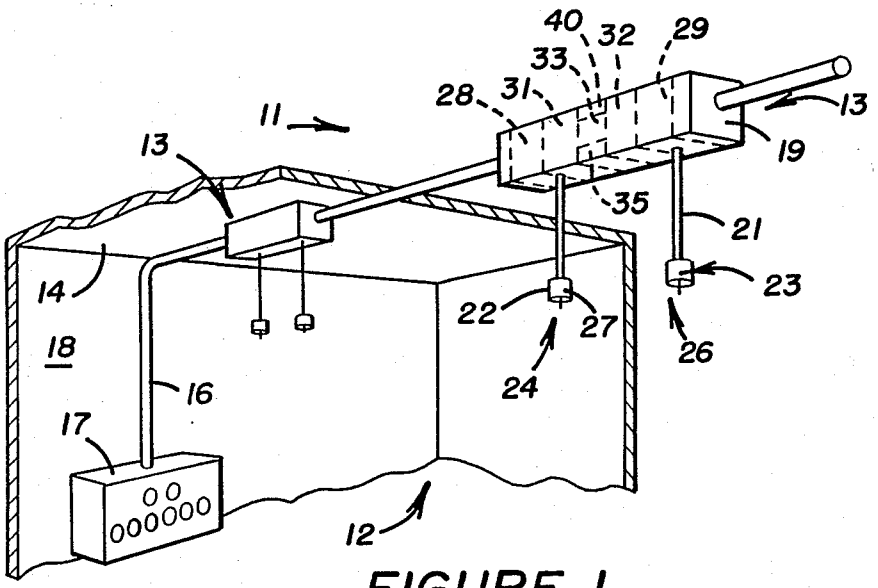
FIG. 1 is a perspective view of a preferred embodiment of the invention shown installed in a room in which static electrical charge accumulations are to be neutralized.

Referring initially to FIG. 1 of the drawings, air ionization apparatus 11 in accordance with this particular embodiment of the invention is designed for installation in a room 12 to suppress electrostatic charge build-up on objects and personnel in the room. A plurality of spaced apart bipolar innizing units 13 are secured to the room ceiling 14 in this example and are interconnected by sections 16 of multiconductor electrical cable one of which extends on to a control housing 17 that may be mounted on a wall 18 at a conveniently accessible location.

While two ionizing units 13 are depicted in FIG. 1 for purposes of example, a single unit may be sufficient in some cases while an array of many more units may be needed to suppress static charge in large area rooms.

Each ionizing unit 13 has a housing 19 and a pair of spaced apart insulative hollow rods 21 extend a distance downward from the housing to support positive and negative ion emitters, 22 and 23 respectively, above the region in which electrostatic charge is to be suppressed. Emitters 22 and 23 each include a downwardly directed sharply pointed electrode, 24 and 26 respectively, which are exposed to ambient air and which are preferably encircled by an insulative annular guard 27 of larger diameter. The electrodes 24 and 26 of this example are thoriated tungsten needles but other electrode materials and configurations, including multi-pointed configurations, may also be used.

Thus much of the physical construction of the ionizing units 13, including emitters 22 and 23, may be similar to that of the corresponding components of the apparatus described in prior U.S. Pat. No. 4,542,434 issued Sept. 17, 1985 to Scott J. S. Gehlke et al and entitled Method and Apparatus for Sequenced Bipolar Air ionization. As in that prior patent, each ionizing unit 13 includes a positive high voltage generator 28 connected to electrode 24 and a negative high voltage generator 29 connected to electrode 26. The present invention is distinct from that of the prior patent, among other differences, in that each ionizing unit 13 also includes a positive voltage control and feedback circuit 31, a negative voltage control feedback circuit 32, a feedback signal summing circuit 33, an indicator and alarm circuit 35 and an individual direct current power supply 40 for the other circuits of the ionizing unit.

As will hereinafter be described in more detail, the voltage control and feedback circuits 31 and 32 maintain a predetermined ion output at each individual emitter 22, 23 in the system without regard to deterioration of individual electrodes, supply voltage fluctuations and certain other variables. This automatically maintains an optimum predetermined ratio of positive and negative air ions throughout the region in which static charge build-up is to be suppressed without requiring external air ion monitoring sensors for control purposes. Localized imbalances of ion polarities from deterioration of a particular electrode 24 or 26 do not develop if the ion output of each electrode in the system is maintained constant.

Figure 2:
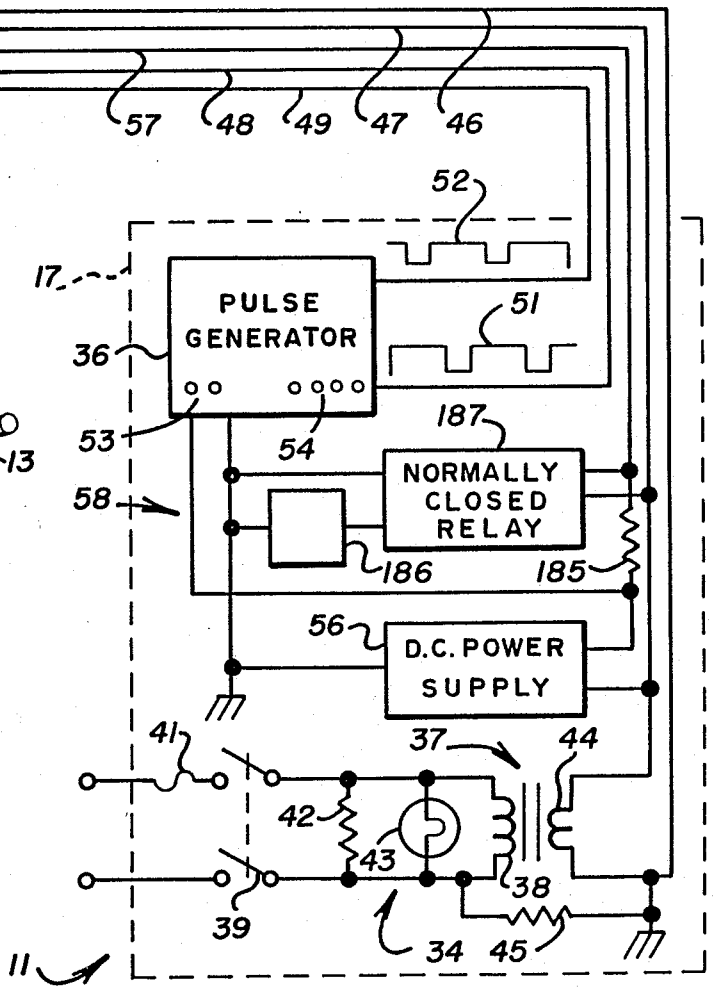
FIG. 2 is a schematic diagram depicting control components of the apparatus of FIG. 1.
Figure 2:
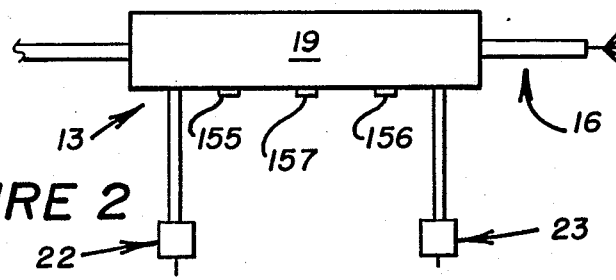

Referring now to FIG. 2, the control housing 17 contains a low voltage alternating current power supply 34 and a timing pulse generator 36 which actuates and deactuates the emitters 22 and 23 and which also enables selection of predetermined levels of positive and negative ion output as will hereinafter be discussed in more detail.

The low voltage power supply 34 of this embodiment has a voltage step-down transformer 37 with a primary winding 28 which receives standard utility line alternating current, at 115 volts in this particular example, through a power on-off switch 39 and protective fuse 41. A varistor 42 is connected in parallel with the primary winding 38 to protect the circuit from power surges that may occur on power lines. An indicator lamp 43, also connected in parallel with winding 38, provides a visual signal that the ionizing apparatus 11 is turned on.

The secondary winding 44 of transformer 37 is connected across a pair of low voltage alternating current conductors 46 and 47 of the cable 16 which extends to the ionizing units 13. A high resistance 45 is connected across the windings 38 and 44 of transformer 37 to enable conductor 46 in particular to function as a common or chassis ground conductor for electrical components of the ionizing units 13. Grounding resistance 45 is not needed if conductor 46 is directly connected to an earth ground. Operation of the ionizing units 13 from stepped down low voltage input power is not essential in all cases but is advantageous as it enables use of light and inexpensive cable 16 for interconnecting the units in the system.

Cable 16 includes two additional conductors 48 and 49 which connect to separate output channels of timing pulse generator 36. Conductor 48 receives a first voltage control signal 51 that determines the ion output of the positive emitters 22 and conductor 49 receives a second voltage control signal 52 which determines the ion output of the negative emitters 23 as will hereinafter be discussed in more detail.

The voltage control signals 51 and 52 can be continuous voltages of selectable magnitude in instances where the positive and negative emitters 22 and 23 are to operate continuously but preferably the pulse generator 36 is of one of the known forms that generate pulsed signals 51, 52 of selectable wave shapes. In this example, signals 51 and 52 alternately drop from a fixed maximum voltage to a selectable lower voltage for a selectable period of time. In addition to controls 53 for selecting the lower voltage level of each signal 51 and 52, pulse generator 36 has additional controls 54 for separately selecting the durations of the voltage drops of each signal 51 and 52 and for selecting an off time interval between each voltage drop of signal 51 and the succeeding voltage drop of signal 52 and also an off time interval between the signal 52 voltage drops and the succeeding signal 51 voltage drop. One example of an adjustable pulse timing circuit adaptable for this purpose is disclosed in U.S. Pat. No. 4,542,434 at column 9, line 64, to column 12, line 11. The alternating operation of the positive and negative ion emitters 22, 23 with intervening off times extends the range of the ionizing apparatus 11 for reasons which will be hereinafter discussed.

Operating power for the pulse generator 36 is provided by a D.C. power supply 56 which may be of known design and which receives A.C. input power from conductor 47. Cable 16 includes an additional conductor 57 which is a component of an alarm circuit 58 that will be hereinafter described.

In this embodiment, transformer 37 supplies 48 volt, 60 cycle alternating current to ionizing units 13 through power conductor 47. Pulse generator 36 delivers +15 volt direct current through conductors 48 and 49 except during the periodic voltage drops at which times the D.C. voltages drop to a selected value in the range from +2 volts to +10 volts depending on the settings of ion output controls 53. Controls 54 in this example enable independent adjustment of the off period following the voltage drops of voltage control signal 51 and the off period following voltage drops of signal 52 and also provide for adjustment of the durations of the voltage drops, each of which may be selected to be in the range from 0 seconds to 9.9 seconds in the present example. It should be recognized that these specific values for voltages and time periods are for purposes of example only and that other values and ranges of values may be appropriate in other embodiments.

Figure 3:
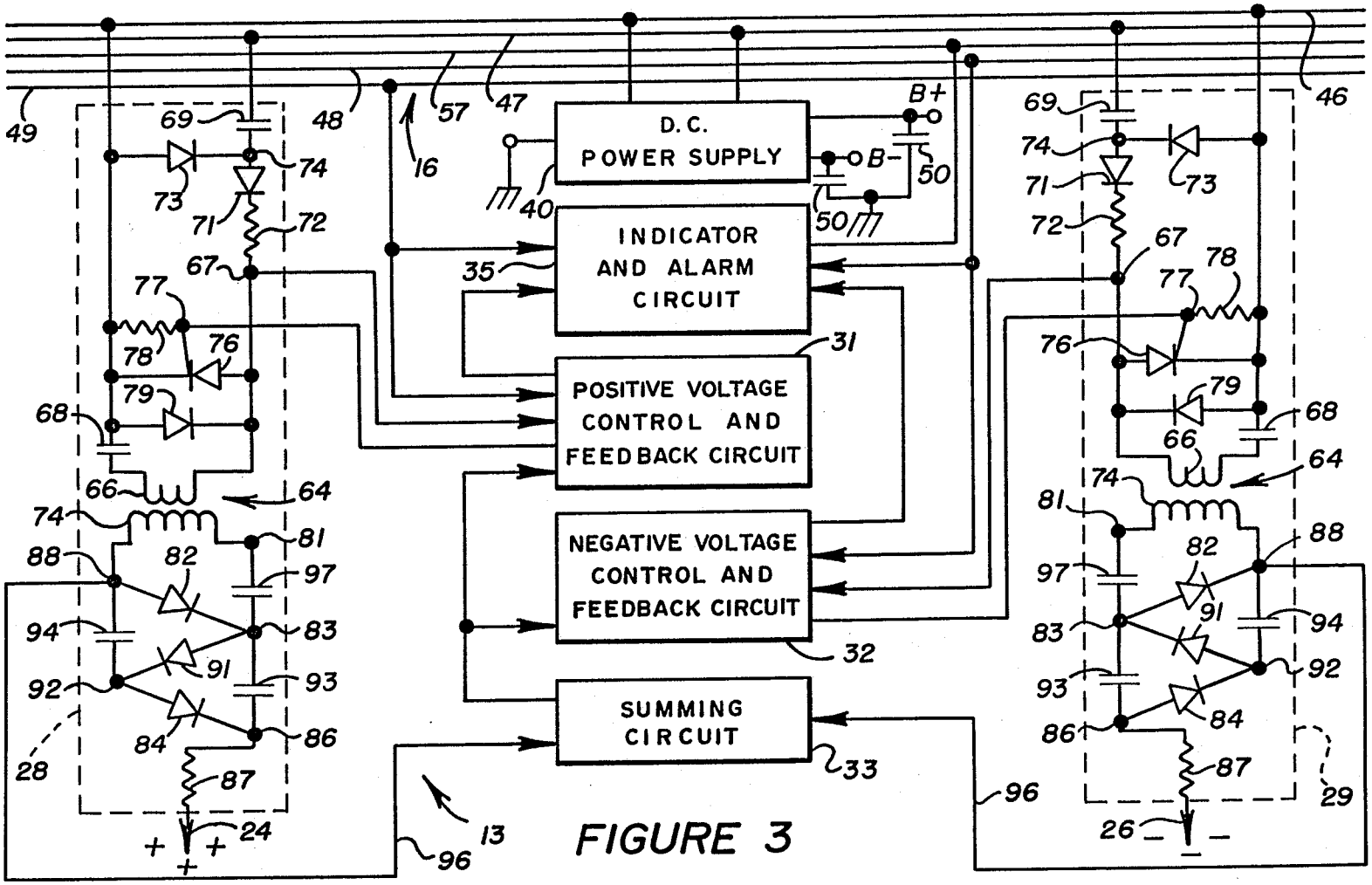
FIG. 3 is a circuit diagram of an individual ionizing unit of the apparatus of FIG. 1

Referring now to FIG. 3, the positive high voltage generator 28, negative high voltage generator 29 and direct current power supply 40 of each ionizing unit 13 are each connected across the alternating current conductor 47 and chassis ground conductor 46 of cable 16.

The positive and negative high voltage generators 28 and 29 may be of identical construction except for a reverse orientation of certain components which will be hereinafter described. Each such generator includes a voltage step-up transformer 64 having a primary winding 66 connected between a circuit junction 67 and ground conductor 46 in series with a charge storing capacitor 68. Circuit junction 67 receives the positive half cycles of alternating current from conductor 47 through a capacitor 69, diode 71 and charging resistor 72. Diode 71 blocks the negative half cycles from circuit junction 67. Thus capacitor 68 acquires a positive charge during the positive half of each cycle of alternating current. The capacitor 68 is discharged through transformer primary winding 66 of the voltage step-up transform 64 during each positive half cycle of alternating current as will hereinafter be described in more detail.

Another diode 73 is connected between ground conductor 46 and a circuit junction 74 between capacitor 69 and diode 71 to enable positive charging of capacitor 69 during the negative half cycles of alternating current. As this charge combines with the additional positive charge applied to capacitor 69 during the positive half cycles of alternating current, capacitor 69 and diode 73 function as a voltage doubler. This results in a maximum voltage, in the present embodiment, of about 135 volts being available to charge capacitor 68 during each positive half cycle.

An SCR (silicon controlled rectifier) 76 is connected between circuit junction 67 and ground conductor 46 to discharge capacitor 68 through primary winding 66 at a particular time in the course of each positive half cycle of the alternating current. This induces a high voltage pulse in secondary winding 74. The magnitude of the voltage developed across the secondary winding 74 is dependent on the timing of the discharge of capacitor 68 in relation to the positive half cycle as the voltage on the capacitor itself progressively increases during the initial portion of the half cycle. Transformer 64 output voltage is relatively low if the capacitor 68 is discharged early in the positive half cycle of alternating current and is maximized if the discharge occurs at or beyond the peak of the half cycle.

The gate terminal 77 of SCR 76 is connected to ground conductor 46 through a gate resistor 78 and receives trigger signal voltage pulses from the associated voltage control and feedback circuit 31 or 32 which determine the timing of firing of SCR 76 and thereby control the output voltage of transformer 64. An additional diode 79 is connected across SCR 76 in a reversed polarity orientation to enable repetitive cycles of damped oscillation in the resonant circuit defined by winding 66 and capacitor 68. The voltage available across secondary winding 74 depends on the positive and negative peak voltages of this oscillation.

One output terminal 81 of transformer 64 connects to the air ionizing electrode 24 or 26 through a capacitor 97, circuit junction 83, another capacitor 93 and circuit junction 86 and a current limiting resistor 87 which prevents an intense discharge if the electrode should be contacted by an external conductive object. The other terminal 88 of secondary winding 74 is connected to chassis ground through an electrical resistance in the associated voltage control and feedback circuit 31 or 32 as will hereinafter be described in more detail.

Grounding terminal 88 is also connected to circuit junction 86, through a capacitor 94, another circuit junction 92 and diode 84. Another diode 91 is connected between junctions 83 and 92 and still another diode 82 is connected between junctions 83 and 88.

The diodes 91, 82 and 84 have opposite orientations in the two high voltage generators 28 and 29. The diodes 91, 82 and 84 of the negative high voltage generator 29 are oriented to enable negative charging of capacitors 93, 94 and 97 by output current from secondary winding 74 and to block discharging of the capacitors through the winding when winding voltage reverses. During the first negative half cycle of winding 74 output, capacitor 97 negatively charges through diode 82 to the peak output voltage. Capacitor 94 is charged to twice the peak voltage, through capacitor 97 and diode 91, during the following positive half cycle. In the next negative half cycle, capacitor 97 charges again to peak voltage and capacitor 93 charges to twice the peak voltage through capacitor 94 and diode 84 as the charge on capacitor 94 transfers to capacitor 93. A negative voltage substantially three times greater than the peak voltage from winding 74 is then impressed on ionizing electrode 26 as capacitors 93 and 97 are in series relationship between the electrode and grounding terminal 88.

The diodes 91, 82 and 84 of the positive high voltage generator 28 are reversed relative to those of the negative high voltage generator. Consequently, the capacitors 93, 94 and 97 of the positive generator 28 acquire positive charge from winding 74 and impress positive voltage on the air ionizing electrode 24 to which that generator is connected.

With reference again to the negative high voltage generator 29 in particular, the intense electrical field adjacent the point of electrode 26 dissociates molecules of the constituent gases of air into ions which exhibit an electrical charge. Dissociation produces negative and positive charges in equal amounts. The negative ions are repelled by the electrode 26 and disperse outward into the surrounding atmosphere. Positive charges are attracted to the electrode 26 and are then neutralized by charge exchange with the electrode. As such charge exchange tends to reduce the voltage across capacitors 93, 94 and 97, a compensating positive current flows out of the high voltage generator 29 through terminal 88, return current conductor 96 and the feedback signal summing circuit 33 to chassis ground. This return current flow has a magnitude proportional to the rate of air ion generation at electrode 26.

Viewed in another manner, it may be seen that the outward dispersion of negative charges from electrode 26 must be matched by an equal flow of positive charges back to ground. Otherwise, accumulating positive charge would rapidly neutralize the negative high voltage.

The positive high voltage generator 28 produces a return current flow on return Current conductor 96, into the feedback signal summing circuit 33, for the same reasons although it is a negative current in this case. The return currents from the two generators 28 and 29 are not necessarily of the same magnitude as air ion outputs from the electrodes 24 and 26 may not be the same.

The voltage control and feedback circuits 31 and 32 function to maintain predetermined rates of ion production at each electrode 24 and 26 by sensing the return current flows and adjusting the voltages produced by the high voltage generators 28 and 29 as needed to maintain the return currents substantially constant.

The D.C. power supply 40 for components of the ionizing unit 13 may be of known design and is connected across A.C. power conductors 46 and 47. The power supply 40 of this example has outputs B+ and B− which respectively provide +15 volts and −15 volts. A supply bypass capacitor 50 is connected between each output and ground to suppress oscillations in the power supply circuit.

Figure 4:
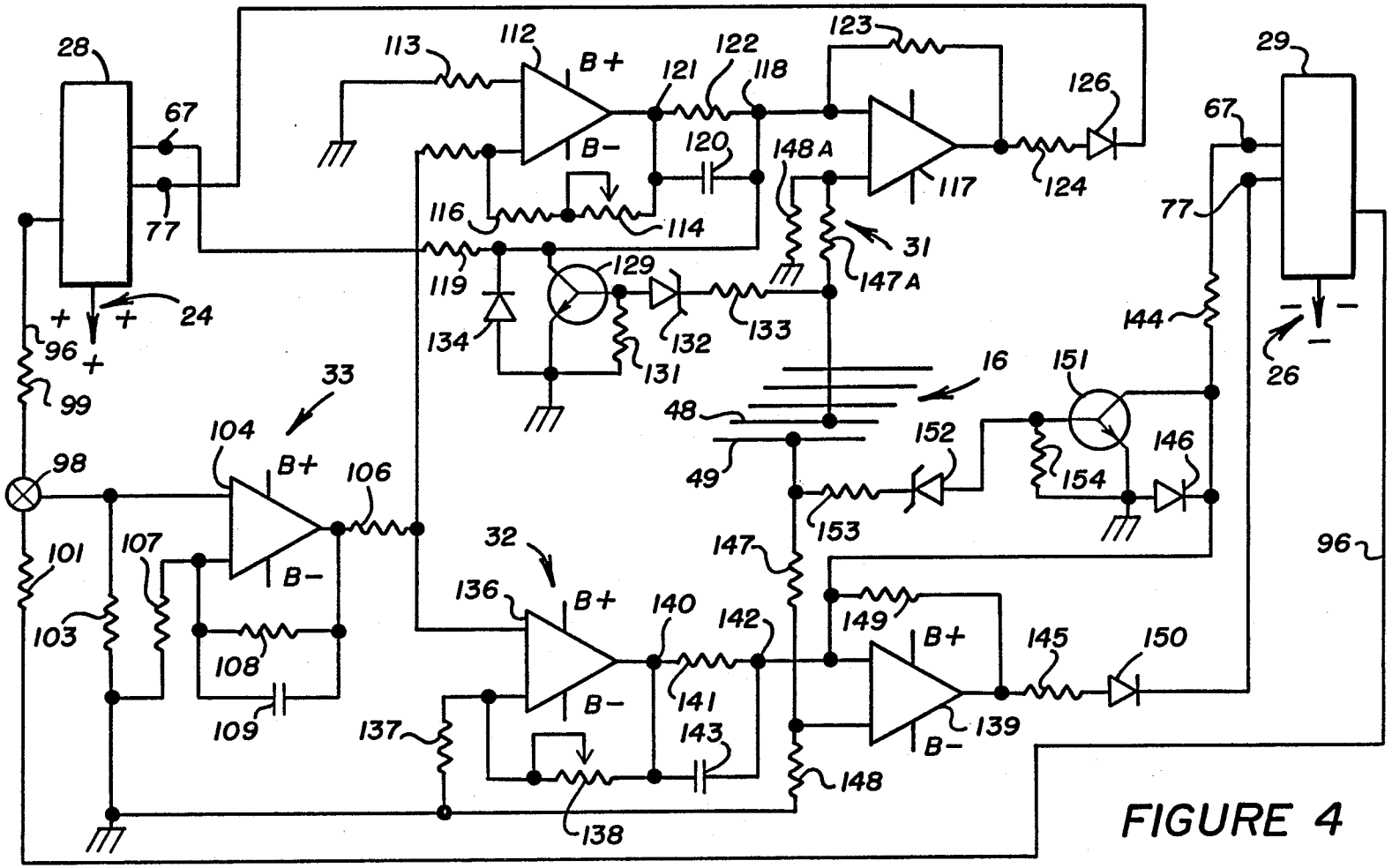
FIG. 4 is a detailed circuit diagram of a summing circuit and positive and negative voltage control and feedback circuit which are shown in block form in FIG. 3.

Referring now to FIG. 4, the return current flows from both high voltage generators 28 and 29 are transmitted to a summing junction 98 through resistors 99 and 101 respectively and then to chassis ground through a high resistance 103 which also functions as a return current sensing resistor. The voltage drop across resistance 103 at a particular time is proportional to the return current flow from the one of the high voltage generators 28 or 29 that is actuated at that time. Further components of the summing circuit 33 include an amplifier 104 having an output which transmits the feedback signals to voltage control and feedback circuits 31 and 32 through a resistor 106. The positive or non-inverting input of amplifier 104 is connected to summing junction 98 and the inverting input is connected to chassis ground through a resistor 107. A feedback resistor 108 connected across the output and inverting input of amplifier 104 fixes the gain of the amplifier and a capacitor 109, connected in parallel with resistor 108 suppresses effects from circuit noise by slightly slowing the response of the amplifier.

Embodiments of the invention may be constructed without the summing circuit 33 by providing separate return current resistors 103 for each high voltage generator 28 and 29 which separately provide feedback signal inputs to the two voltage control and feedback circuits 31 and 32. The advantage of the summing circuit 33 is that it compensates for a form of air ion loss that can significantly reduce the effective ion output of systems which have pairs of ionizing electrodes 24 and 26 situated in proximity to each other. In particular, a sizable portion of the ions generated by each electrode 24, 26, can be attracted to the other electrode and be neutralized. This results in an outflow of electrical charge from the high voltage generator 28 or 29 that is connected to the other electrode, through the return current conductor 96 of that generator, the outflow being proportional to the rate at which such air ion neutralization is occurring. The summing circuit 33 combines this charge outflow with the return current from the active generator 28 or 29 at summing junction 98. As the voltage input to junction 98 from the inactive generator 28 or 29 is of opposite polarity from that of the active generator, the resulting feedback signal voltage transmitted by amplifier 104 is reduced by an amount proportional to the rate of ion neutralization at the inactive electrode. The active voltage control and feedback circuit 31 or 32 cannot distinguish this from a feedback signal reduction caused by reduced ion generation and reacts by raising the voltage produced by the active high voltage generator by an amount which compensates for the ion neutralization at the inactive electrode.

Positive voltage control and feedback circuit 31 has an input amplifier 112 with a non-inverting input which receives the feedback signal from summing circuit 33. The inverting input of amplifier 112 is connected to chassis ground through a resistor 113. A variable feedback resistor 114 is connected across the non-inverting input and the output of amplifier 112, in series with a fixed resistor 116, to enable selective adjustment of the gain of the amplifier. This provides for selection of a positive ion output rate at electrode 24 that may differ from the negative ion output rate at electrode 26 in circumstances where that is desirable.

Trigger pulses having a timing which determines the magnitude of the voltage produced by the positive high voltage generator 28 are produced by a comparator 117 of the type which transmits output voltage when the voltage at one input rises to equal or exceed a reference voltage applied to the other input. The inverting input of comparator 117 is connected to cable conductor 48 through resistor 147A and to chassis ground through resistor 148A and thus receives the previously described positive voltage control signal which periodically drops from a fixed maximum value to a selected lower Value that is indicative of a desired ion output rate, the maximum value being +15 volts and the lower value being in the range from +2 volts to +10 volts in this particular example.

Referring to FIGS. 3 and 4 in conjunction, the positive input of comparator 117 is connected to circuit junction 67 of positive high voltage generator 28 through a circuit junction 118 and resistor 119 and thus receives an alternating voltage which rises and falls in correspondence with the alternating current which is supplied to the generator. Voltage dropping resistor 119 reduces the maximum value of the alternating voltage at junction 118 to +10 volts, in this example, which maximum value occurs when the positive A.C. current half cycles at generator junction 67 are at their peaks. That is also the voltage applied to the inverting input of comparator 177 from cable conductor 48 when the positive voltage control signal has been selected to provide maximum ion output.

Amplifier 112, which inverts the return current feedback signal from summing circuit 33, has an output 121 connected to circuit junction 118 through a resistor 122. A capacitor 120, connected in parallel with resistor 122, suppresses circuit noise. Thus the A.C. voltage signal which is presented to comparator 117 is modified by being combined with the inverted return current feedback signal from the positive high voltage generator 28. This in effect delays the rise of voltage at the positive input of comparator 117 during each positive half cycle of the alternating current by an amount which is inversely dependent on the magnitude of the feedback signal from the positive high voltage generator 28 which signal is indicative of ion output at electrode 24. A decreased feedback signal, indicative of reduced ion output, causes the comparator 117 to transmit a trigger signal at a later stage of each A.C. positive half cycle and an increased feedback signal advances the timing of the trigger signals.

A positive feedback resistance 123 is connected between the output and positive input of comparator 117 and the comparator output is connected to the previously described SCR gate terminal 77 of positive high voltage generator 28 through a resistor 124 and diode 126. Diode 126 blocks reversed voltage transients.

As previously described, the timing of trigger signals at SCR gate terminal 77 in relation to the positive half cycles of alternating current determines the magnitude of the high voltage produced by generator 28. Thus the voltage control and feedback circuit 31 functions to maintain a substantially constant positive ion output by varying the timing of the trigger signals as needed for the purpose.

Generation of trigger signals by comparator 117 is inhibited during the periods between actuations of the high voltage generator 28 as the voltage control signal from cable conductor 48 rises, to +15 volts in this example, during such periods. It is preferable to ground circuit junction 118 during such periods to assure an abrupt termination of the trigger signals as the A.C. voltage signal continues to be received through resistor 119 and a period of time is required for dissipation of the high voltage on electrode 24 during which return current feedback continues to be received.

For this purpose, a transistor 129 of the NPN form in this example has a collector-emitter circuit connected between junction 118 and chassis ground. The base of transistor 129 is connected to chassis ground through a resistor 131 and to the positive voltage control signal conductor 48 through a zener diode 132 and resistor 133. Zener diode 132 becomes conductive in response to the full power supply voltage which appears on conductor 48 during the off intervals and applies bias voltage to the base of transistor 129. This causes the transistor to become conductive thereby assuring that the voltage at the positive input of comparator 117 is immediately reduced to substantially zero. A diode 134 is connected between junction 11B and ground to protect the comparator 117 from negative voltage transients.

The negative voltage control and feedback circuit 32 may be similar in most respects to the above described positive circuit 31 although the input amplifier 136 is connected to transmit the feedback signal from summing circuit 33 without inversion as the return current is of opposite polarity during operation of the negative high voltage generator 29. In particular, the positive or non-inverting input of the input amplifier 136 is connected to the output resistor 106 of summing circuit 33 while the inverting input is connected to chassis ground through a resistor 137.

A variable feedback resistor 138 is connected across the output and inverting input of amplifier 136 to enable independent adjustment of negative ion output rate and the output of the amplifier is connected to the positive input of a comparator 139 through a circuit junction 140, a resistor 141 and another junction 142, a capacitor 143 being connected in parallel with resistor 141. A resistor 144 transmits the A.C. voltage signal from terminal 67 of negative high voltage generator 29 to junction 142 and a diode 146 is connected between the junction and chassis ground. The other input of comparator 139 is connected to negative voltage control signal conductor 49 through a resistor 147 and to chassis ground through another resistor 148. A feedback resistance 149 is connected between the positive input and output of comparator 13 and the comparator transmits trigger signals to SCR gate terminal 77 of the negative high voltage generator 29 through a resistor 145 and diode 150.

The function and operation of the above described components of circuit 32 are similar to those of the corresponding components of the previously described positive voltage control and feedback circuit 31.

As in circuit 31, a transistor 151 is connected between circuit junction 142 and chassis ground to assure an abrupt termination of trigger signals at the end of each voltage control pulse, the base of the transistor being connected to negative voltage control signal conductor 49 through a zener diode 152 and resistor 153 and to chassis ground through a resistor 154.

Figure 5:
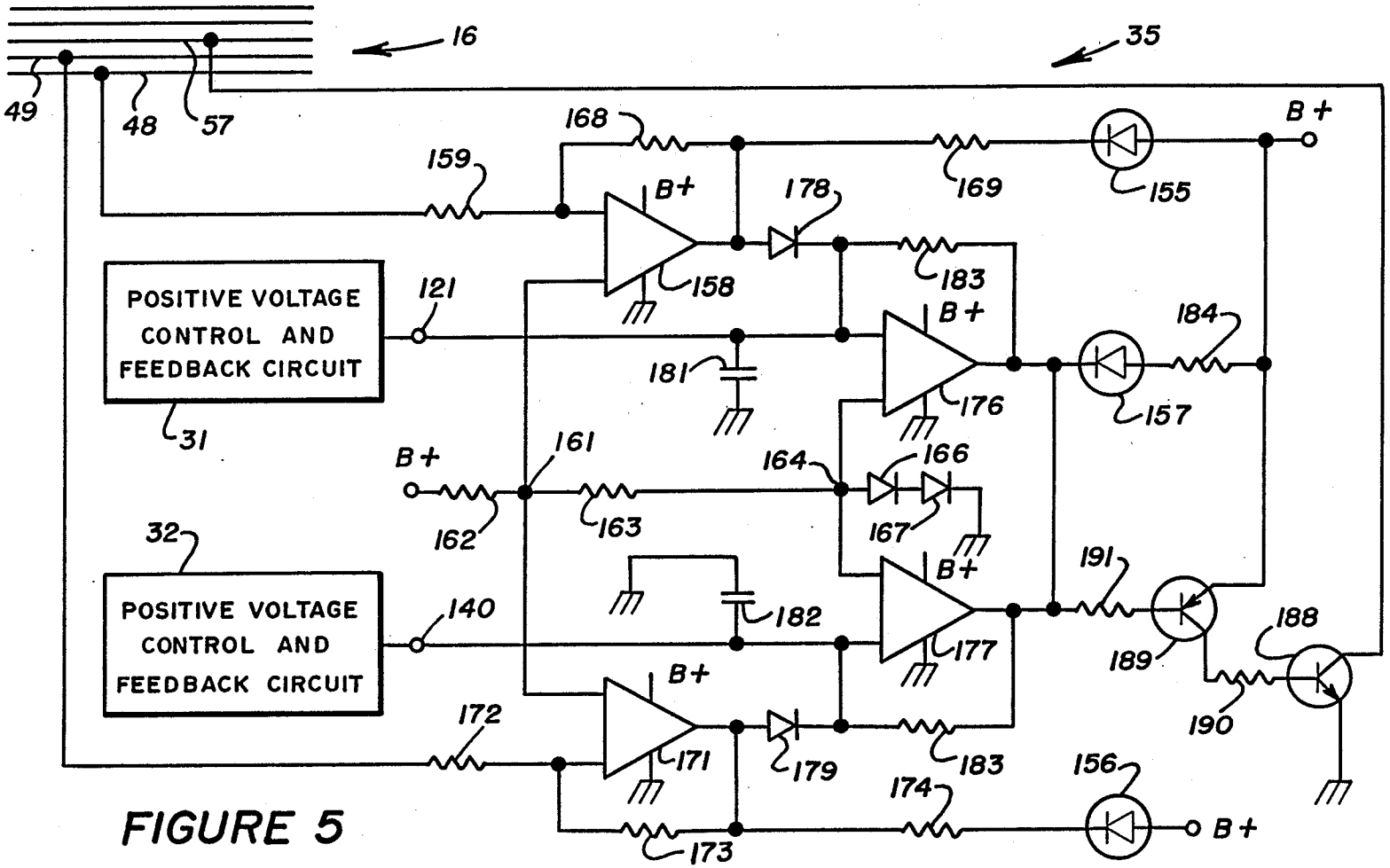
FIG. 5 is a circuit diagram of an indicator and alarm circuit which may be provided in the apparatus of the preceding figures.

It is advantageous if operation of the air ionizing apparatus can be easily monitored to assure that it is operating properly and if it signals the existence of a malfunction if that should occur. Referring to FIG. 5, an indicator and alarm circuit 35 may be included for this purpose.

A first light emitting diode 155, hereinafter termed an LED, visually indicates periods of positive ion generation and a second LED 156 indicates periods of negative ion generation. A third LED 157 visually indicates a loss of ion generation if that should occur while the system is actuated. As depicted in FIG. 2, the LEDs 155, 156, 157 are situated at the surface of the housing 19 of the air ionizing unit 13 at a location where they are readily visible to persons in the area.

Referring again to FIG. 5, LED 155 is controlled by a comparator 158 having a positive input connected to the positive voltage control signal conductor 48 of cable 16 through an input resistor 159. The reference input of comparator 158 receives a voltage, of +10 volts in this example, from a junction 161 between voltage divider resistors 162 and 163 which are connected between D.C. power supply terminal B+ and chassis ground in series with another junction 164 and a pair of diodes 166, 167 which function as a further resistance. A positive feedback resistance 168 is connected across the positive input and output of comparator 158 and the output is further connected to D.C. power supply terminal B+ through a resistor 169 and LED 155.

As previously described, the positive voltage control signal from conductor 48 is +15 volts except when positive ions are being generated at which time it drops to a selected lower value in the range from +2 to +10 volts. Thus the voltage at the positive input of comparator 158 equals or exceeds the +10 volts at the reference input, from junction 161, during the periods when positive ions are not being generated. Consequently, the output of comparator 158 is high at such times and no current flows through LED 155. The output of comparator 158 goes low during the positive ion generation periods as a result of the drop of the positive voltage control signal. This enables current flow through LED 155 which then emits light and visually signals that positive ion generation is occurring.

Generation of a visual signal by LED 156 that negative ion production is occurring is accomplished by similar circuitry. In particular, one input of another comparator 171 receives the negative voltage control signal through a resistor 172 while the reference input receives +10 volts, in this embodiment, from circuit junction 161. A positive feedback resistance 173 is connected across the input and output of the comparator 171 and the output is connected to D.C. power supply terminal B+ through a resistor 174 and LED 156.

The alarm LED 157, which visually signals a loss of ion output, can be actuated by either of two additional comparators 176 and 177. The reference inputs of both comparators 176 and 177 are connected to junction 164 to receive a low D.C. voltage of +1.2 volts in this example. The positive input of comparator 176 is connected to previously described terminal 121 of positive voltage control and feedback circuit 31 to receive the return current feedback signal during periods of positive ion generation and also receives the output of comparator 158 through a diode 178. The positive input of comparator 177 receives the return current feedback signal during periods of negative ion generation, from previously described terminal 140 of circuit 32 and is also connected to the output of comparator 171 through a diode 179. Capacitors 181 and 182 are connected between chassis ground and the inputs of comparators 176 and 177 respectively to slow the response of the comparators to changes of input voltage, by about $\frac{1}{4}$ second in this example. Both comparators 176 and 177 have a positive feedback resistance 183 and the outputs of both comparators are connected to D.C. power terminal B+ through LED 157 and a resistor 184.

The output of comparator 176 is normally high during periods when positive ion generation is occurring as the feedback signal voltage received from circuit 31 exceeds the low reference voltage from junction 164. Consequently there is no significant current flow through alarm LED 157 and the alarm remains off. This condition normally continues after the interval of positive ion generation as the comparator 176 then receives high input voltage from comparator 158 which goes high as the positive voltage control signal from conductor 48 has then risen to +15 volts as previously described. The output of comparator 176 goes low if feedback signal voltage is not received during a period when the output of comparator 158 is also low indicating that positive ion generation should be occurring. The low condition at the output of comparator 176 enables current flow through alarm LED 157 which then blinks to visually signal the occurrence of malfunction. The positive feedback assures reliable circuit operation by preventing unwanted oscillations when the alarm condition occurs.

Comparator 177 operates to actuate the alarm LED 157 in a similar manner if the negative feedback signal voltage from circuit 32 should not be received at a time when the voltage on conductor 49 has dropped indicating that negative ion production should be occurring.

It is advantageous if actuation of the alarm LED 157 at any particular one of the ionizing units is accompanied by actuation of a master alarm 186 which in the present embodiment is situated at the control housing 17 as shown in FIG. 2. Alarm 186 is a beeper which emits an audible signal in this example but may also be of any of the various other forms of electrically actuated audible or visual signaling devices.

Alarm 186 is connected across A.C. power conductors 46 and 47 in series with a normally closed relay 187 which is preferably of the type which exhibits a small time delay before closing in response to cessation of driver current. Under ordinary conditions, relay 186 is held open to inactivate the alarm by driver current from cable conductor 57 which is connected to the D.C. power supply 56 though a resistor 185. Referring again to FIG. 5, the indicator and alarm circuit 35 of each ionizing unit includes an NPN transistor 188 having an emitter-collector circuit connected between cable conductor 57 and chassis ground. A PNP transistor 189 has an emitter-collector circuit connected between the D.C. power supply terminal B+and the base of transistor 188 in series with a voltage dropping resistor 190. The outputs of both comparators 176 and 177 are connected to the base of transistor 189 through a resistor 191.

If the output of either comparator 176 or 177 goes low as hereinbefore described, signaling a loss of ion output, transistor 189 is biased into conduction and applies base bias voltage to transistor 188 which then also becomes conductive. This grounds cable conductor 57 causing the voltage on the conductor to drop substantially to zero. Referring again to FIG. 2, grounding of conductor 57 causes relay 187 to close and apply actuating current to alarm 186.

Referring again to FIG. 1, ion output rate of the apparatus 11 is initially adjusted at control housing 17 to establish an air ion concentration and ratio of positive to negative ions that is effective to suppress electrostatic charge build-up on objects in the particular room 12. The optimum concentration and ratio may vary from room to room but can be ascertained during initial adjustments by using charge detectors of known design to sense charge at localized regions and then raising the output of ions of opposite polarity to eliminate such accumulations. The output of any single emitter 22 or 23 relative to the others may be raised or lowered as needed for this purpose by changing the gain of the feedback circuit amplifier (shown in FIG. 4) which is coupled to that emitter by adjustment of the amplifier feedback resistor 114 or 138.

Referring again to FIG. 1, the apparatus 11 then very effectively inhibits static charge build-up on objects in room 12 over an extended period of time without requiring continual monitoring of the ion content of the air with ion sensors or the like. Electrode deterioration and line voltage fluctuations do not affect the ion output of each emitter 22, 23. A localized imbalance of positive and negative ions does not occur if the electrode 24 or 26 of a particular emitter 22, 23 should deteriorate at a greater rate than a nearby electrode of opposite polarity. The ion output of each emitter 22, 23 remains constant without regard to such variables. Readjustment of the apparatus 11 may be desirable if there are major changes in the content of the room 12 or in activities in the room but this is not usually necessary on any frequent basis.

The herein described embodiment of the invention produces positive and negative ions alternately at periods separated by of intervals during which there is no ion production. This extends the effective range of the ionizing apparatus 11 as ions of each polarity are able to disperse further from the emitters 22 and 23 before substantial intermixing and mutual neutralization occurs. The invention is also applicable to systems in which there is no delay between alternating periods of positive and negative ion production or which generate ions of both polarities simultaneously.

Single electrode air ionizers producing ions of only one polarity tend to impart charge to nearby objects and thus are not normally used for the purposes of the above described embodiment. Such unipolar ionizers are extensively used for other purposes, such as improving the physiological effects of air, and a single feedback circuit 31 or 32 in accordance with the invention may be included in such devices if it is desired to maintain a constant ion output.

While the invention has been disclosed with respect to a single embodiment for purposes of example, many modifications and variations are possible and it is not intended to limit the invention except as defined in the following claims.

We claim:

1. Air ionizing apparatus having at least one electrode exposed to air which is to be ionized, a direct current high voltage generator connected to said electrode to apply sustained high voltage of a predetermined polarity thereto at least for limited periods of time, a ground return electrical resistance through which a flow of electrical charges of opposite polarity is conducted away from said electrode and said high voltage generator at a rate corresponding to the rate of air ion production by said electrode, and means for preventing outflow of electrical charges of said predetermined polarity from said electrode through said resistance, wherein the improvement comprises:

sensing means for producing an electrical feedback signal, said sensing means being connected to said resistance to sense variations of said flow of electrical charges of opposite polarity by sensing variations of the voltage drop across said resistance whereby the feedback signal has a magnitude that varies in correspondence with variations of the rate of production of ions of said predetermined polarity at said electrode, and voltage adjusting means for receiving said feedback signal and for causing said high voltage generator to apply higher voltage to said electrode in response to a decrease of said feedback signal and to apply lower voltage to said electrode in response to an increase of said feedback signal.

2. The apparatus of claim 1 further including control means for generating a voltage control signal indicative of a desired ion output rate and wherein said voltage adjusting means varies the high voltage produced by said high voltage generator in accordance with changes in said voltage control signal and in inverse relationship to changes in said feedback signal.

3. The apparatus of claim 1 wherein said high voltage generator receives input power having a cyclical voltage which periodically increases and decreases and further includes means for varying the high voltage at said electrode in response to variations in the timing of repetitive trigger signals relative to said increases and decreases of said cyclical voltage, wherein said voltage adjustment means transmits said trigger signals to said high voltage generator and varies the timing of said trigger signals in response to changes in the magnitude of said feedback signal.

4. The apparatus of claim 3 wherein said voltage adjusting means includes a comparator having first and second inputs and having an output connected to said high voltage generator to apply said trigger signals thereto, means for combining said feedback signal with another signal which increases and decreases in correspondence with said cyclical voltage and for applying the combined signals to said first input, and means for applying a reference signal of selectable magnitude to said second input.

5. The apparatus of claim 1 having a plurality of said electrodes and a plurality of said high voltage generators each coupled to a separate one of said electrodes and each having an independently adjustable high voltage output, further including control means for transmitting input current to each of said high voltage generators, and wherein said sensing means produces a plurality of said feedback signals each indicative of ion output at a separate one of said electrodes, said apparatus having a plurality of said voltage adjustment means each connected to a separate one of said high voltage generators and being responsive to the separate one of said feedback signals that originates from said separate one of said generators.

6. The apparatus of claim 5 wherein at least a first of said high voltage generators produces positive high voltage and at least a second of said generators produces negative high voltage.

7. Air ionizing apparatus having first and second electrodes exposed to air which is to be ionized, a first high voltage generator coupled to said first electrode to apply positive high voltage thereto and a second high voltage generator coupled to said second electrode to apply negative high voltage thereto, each of said high voltage generators having an independently adjustable high voltage output, a ground return electrical resistance through which electrical charges of opposite polarity are conducted away from said first and second high voltage generators at a rate corresponding to the rate of air ion production by the electrode that is coupled to the generator, and control means for transmitting input current to each of said high voltage generators, wherein said control means actuates said first and second high voltage generators intermittantly and alternately, wherein the improvement comprises:

sensing means for producing a first electrical feedback signal which has a magnitude that varies in correspondence with variations of the voltage drop across said electrical resistance and which is indicative of ion output at said first electrode and for producing a second electrical feedback signal which has a magnitude that varies in correspondence with variations of the voltage drop across said electrical resistance and which is indicative of ion output at said second electrode first and second voltage adjusting means for respectively receiving said first and second feedback signals, said first voltage adjusting means being connected to said first high voltage generator and being responsive to said first feedback signal that originates therefrom and wherein said first voltage adjusting means causes said first high voltage generator to apply higher voltage to said first electrode in response to a decrease of said first feedback signal and to apply lower voltage to said first electrode in response to an increase of said first feedback signal, said second voltage adjusting means being connected to said second high voltage generator and being responsive to said second feedback signal that originates therefrom and wherein said second voltage adjusting means causes said second high voltage generator to apply higher voltage to said second electrode in response to a decrease of said second feedback signal and to apply lower voltage to said second electrode in response to an increase of said second feedback signal, and wherein said sensing means includes a summing circuit connected to combine said electrical charge flows from both of said first and second high voltage generators and to transmit the combined charge flows to said electrical resistance whereby said voltage adjusting means adjusts the voltages produced by each generator during operation thereof to compensate for ion neutralization at the electrode connected to the other of said generators.

8. The apparatus of claim 7 wherein said summing circuit includes a circuit junction and a pair of resistors each being connected between said circuit junction and a separate one of said high voltage generators to transmit said electrical charge flows from each of said generators to said junction, means for transmitting charge flow from said junction to said electrical resistance, and an amplifier having an input connected to said circuit junction and an output connected to each of each of said voltage adjustment means to apply the feedback signal thereto.

9. The apparatus of claim 5 wherein said control means produces a positive voltage control signal of selectable magnitude and a negative voltage control signal of independently selectable magnitude and wherein said first and second voltage adjustment means vary the voltage produced by said first and second high voltage generators respectively in response to changes in said positive and negative voltage control signals respectively in addition to varying said voltages in response to said feedback signals.

10. The apparatus of claim 1 having at least a pair of said high voltage generators and at least a pair of said electrodes each connected to a separate one of said high voltage generators, a first of said generators being a positive high voltage generator and the second of said generators being a negative high voltage generator, said apparatus having first and second ones of said voltage adjusting means each connected to a separate one of said generators, further including control means for producing timing signals which intermittantly and alternately actuate the opposite and negative high voltage generators, and means for deactuating each voltage adjusting means in response to said timing signals during the intermittant periods that the generator connected thereto is deactuated by said control means.

11. The apparatus of claim 10 wherein said control means alternately produces first and second voltage control signals and wherein said first voltage adjustinq means responds to said first voltage control signals by actuating said first generator and said second voltage adjusting means responds to said second voltage control signal by actuating said second generator.

12. Air ionizing apparatus having at least a pair of electrodes exposed to air which is to be ionized, at least a pair of high voltage generators each being connected to a separate one of said electrodes to apply high voltage of a predetermined polarity thereto, a first of said generators being a positive high voltage generator and the second of said generators being a negative high voltage generator, a ground return electrical resistance through which electrical charges of opposite polarity are conducted away from said high voltage generators at at rate corresponding to the rate of air ion production by said electrodes, control means for intermittantly and alternating actuating the positive and negative high voltage generator wherein said control means alternately produce first and second voltage control signals, wherein the improvement comprises:

sensing means for producing an electrical feedback signal having a magnitude that varies in correspondence with variations of the voltage drop across said electrical resistance, first and second voltage adjusting means for receiving said feedback signal and being connected to said first and second high voltage generators respectively, wherein said first voltage adjusting means responses to said first voltage control signal by actuating said first generator and said second voltage adjusting means responds to said second voltage control signal by actuating said second generator and wherein each of said voltage adjusting means causes the high voltage generator which is connected thereto to apply higher voltage to the electrode to which it is connected in response to a decrease of said feedback signal and to apply lower voltage to the electrode in response to an increase of the feedback signal, means for deactuating each voltage adjusting means during the intermittant periods that the generator connected thereto is deactuated by said control means further including an alarm circuit having an electrically actuated signaling device and alarm control means for comparing said feedback signals and said voltage control signals and for energizing said device if a feedback signal drops to a predetermined value during a period when said control means is producing a voltage control signal.

13. The apparatus of claim 12 further including an alarm signal conductor, an electrical power supply connected to said conductor to transmit a predetermined voltage thereto, means for actuating said signaling device in response to a reduction of the voltage on said conductor, and wherein said alarm control means reduces said voltage on said conductor if said feedback signal drops to said predetermined value during a period when said control means is producing a voltage control signal.

14. In air ionizing apparatus having a plurality of spaced apart ion emitters, and an electrical power source, and a plurality of direct current high voltage generators each being connected to said power source and to a separate one of said ion emitters and each having an electrically resistive path through which a return current flows away from the high voltage generator that is of opposite polarity from the high voltage produced thereby and which has a magnitude corresponding to the rate of ion output from the ion emitter which is connected thereto, each of said high voltage generators further having means for preventing conduction of said high voltage through said resistive path, a first portion of the high voltage generators being positive high voltage generators and a second portion thereof being negative high voltage generators, the combination comprising:

return current sensing means for producing a plurality of feedback signal voltages, each of said sensing means being connected to said resistive path of a separate one of said high voltage generators to produce a feedback signal which varies in accordance with variations of said return current flow of opposite polarity from the separate one of said high voltage generators, and means for varying the high voltage produced by each of said generators in inverse relationship to variations of the feedback signal voltage from that particular generator, whereby said apparatus maintains a predetermined total ion output and produces negative and positive ions at a substantially constant ratio.

15. The apparatus of claim 14 further including means for selectively varying the high voltage produced by each one of said generators independently of the high voltage produced by the others thereof.

16. Air ionizing apparatus comprising:

a plurality of spaced apart air ionizing units each having at least one ion emitter electrode exposed to ambient air, a plurality of high voltage generators in said units each having a direct current high voltage output connected to a separate one of said electrodes and each having means for varying output voltage in response to a voltage control signal, a first portion of said generators being positive high voltage generators and a second portion being negative high voltage generators, a control housing having an electrical power source and means for alternately and repetitively producing a first voltage control signal for said positive high voltage generators and a second voltage control signal for said negative high voltage generators, a multi-conductor electrical cable extending from said control housing to each of said ionizing units and having a input power conductor connected to each of said high voltage generators, a ground return conductor connected to each of said high voltage generators and having first and second voltage control signal conductors.

a plurality of electrical resistances each being connected between said ground return conductor and a separate one of said high voltage generators to transmit a ground return current flow out of the generator that is of opposite polarity from the high voltage produced thereby and which has a magnitude equal to the ion output at the electrode connected thereto, means for blocking conduction of said high voltage to said ground return conductor through said resistances, a plurality of feedback circuits each being connected between a separate one of said high voltage generators and said ground return conductor and one of said first and second voltage control signal conductors, each of said feedback circuits having means for actuating the generator connected thereto in response to received voltage control signals and means for varying the voltage output of the generator connected thereto in inverse relationship to variations of said ground return current flow through the one of said resistances which is connected to the generator.

17. Air ionizing apparatus comprising:

a plurality of spaced apart air ionizing units wherein each of said ionizing units has a pair of ion emitter electrodes exposed to ambient air, a pair of high voltage generators in each of said units each having a high voltage output connected to a separate one of said electrodes and each having means for varying output voltage in response to a control signal, one of said pair pair of generators being a positive high voltage generator and the other being a negative high voltage generator, a control housing having an electrical power source and means for alternately and repetitively producing a first voltage control signal for said positive high voltage generators and a second voltage control signal for said negative high voltage generators, a multi-conductor electrical cable extending from said control housing to each of said ionizing units and having an input power conductor connected to each of said high voltage generators, a ground return conductor connected to each of said high voltage generators and which receives a ground return current flow form each generator that is of opposite polarity from the high voltage produced thereby and which has a magnitude equal to the ion output at the electrode connected thereto, and having first and second voltage control signal conductors, wherein each of said units includes a pair of feedback circuits each being connected between a separate on of said pair of high voltage generators and said ground return conductor and one of said first and second voltage control signal conductors, each of said feedback circuits having means for actuating the generator connected thereto in response to received voltage control signals and means for varying the voltage output of the generator connected thereto in inverse relationship to variations of said return current flow therefrom, further including means for detecting neutralization of ions form one of said electrodes by charge exchange with the other of said electrodes, and means for adjusting the high voltage produced by the generator coupled to said one electrode by an amount sufficient to compensate for said neutralization.

18. In apparatus for ionizing air, the combination comprising first and second air ionizing electrodes, first and second high voltage sources connected to said first and second electrodes respectively, each of said high voltage sources having a ground return terminal which transmits an outflow of electrical charges that are of opposite polarity from the high voltage supplied by the source and which outflow has a magnitude that corresponds to the rate of air ion generation by the electrode to which the source is connected during periods when the source is actuated, means for intermittantly and alternately actuating said first and second high voltage sources, an electrical resistance, summing circuit means for combining charge outflows from said ground return terminals of both of said high voltage sources and for transmitting the combined charge outflows through said electrical resistance, sensing means for producing a feedback signal having a magnitude that varies in correspondence with variations of the voltage drop across said electrical resistance, and voltage adjusting means for receiving said feedback signal and for causing each high voltage source to vary the voltage output thereof in inverse relationship to variations of said feedback signal during periods when the high voltage source is actuated.

* * * * *